United States Patent [19]

Kirby et al.

[11] 4,147,123

[45] * Apr. 3, 1979

[54] BARGE-CARRYING WATERBORNE VESSEL FOR FLOTATION LOADING AND UNLOADING, AND TRANSPORTATION METHOD

[75] Inventors: William E. Kirby, Victoria, Hong Kong; David J. Seymour, Daly City, Calif.

[73] Assignee: Wharton Shipping Corporation, Edificio Vallarino, Panama

[ * ] Notice: The portion of the term of this patent subsequent to Jan. 23, 1996, has been disclaimed.

[21] Appl. No.: 842,280

[22] Filed: Oct. 14, 1977

Related U.S. Application Data

[63] Continuation-in-part of Ser. No. 775,936, Mar. 9, 1977, which is a continuation-in-part of Ser. No. 701,696, Jul. 1, 1976, abandoned.

[51] Int. Cl.[2] ..... B63B 35/40

[52] U.S. Cl. ..... 114/260

[58] Field of Search ..... 114/258, 259, 260, 72, 114/73, 75

[56] References Cited

U.S. PATENT DOCUMENTS

| | | | |
|---|---|---|---|
| 2,605,064 | 7/1952 | Davis | 114/75 |
| 3,939,790 | 2/1976 | Varges et al. | 114/260 |

FOREIGN PATENT DOCUMENTS

| | | | |
|---|---|---|---|
| 1804369 | 5/1970 | Fed. Rep. of Germany | 114/260 |

*Primary Examiner*—George E. A. Halvosa
*Assistant Examiner*—Jesus D. Sotelo
*Attorney, Agent, or Firm*—Owen, Wickersham & Erickson

[57] ABSTRACT

A transportation method and a barge-carrying waterborne vessel in which there is flotation loading and unloading, with the loading being assisted by water flow from the gate into the flooded vessel and toward the opposite end of the vessel from the gate. For unloading, the water flows in the opposite direction, toward the gate. Preferably, loading is through a gate in the stern while water is being pumped out from a sump at the forward end of a hold. When barges are fully loaded into the hold, the stern gate is closed and the hold may be dried out; then the barges are secured in place against movement relative to the vessel. There may be more than one hold having at least one longitudinal bulkhead dividing the holds. There may be either a separate gate for each hold or a transfer system in which each longitudinal bulkhead has an archway providing a passageway joining adjacent holds. During lateral transfer water jets may play against the sides of the barge to cause lateral movement. Adjacent the gate there are preferably rollers, some of which are powered, which engage the sides of each barge and move it into or out from the gate and the hold. Novel barge retention systems are provided requiring relatively few, if any, powered devices.

42 Claims, 24 Drawing Figures

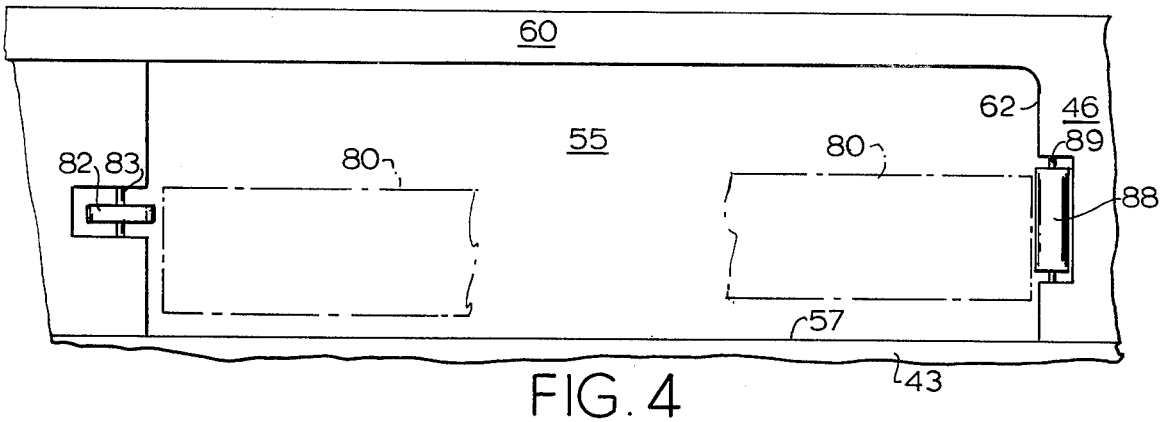
FIG. 4
FIG. 6
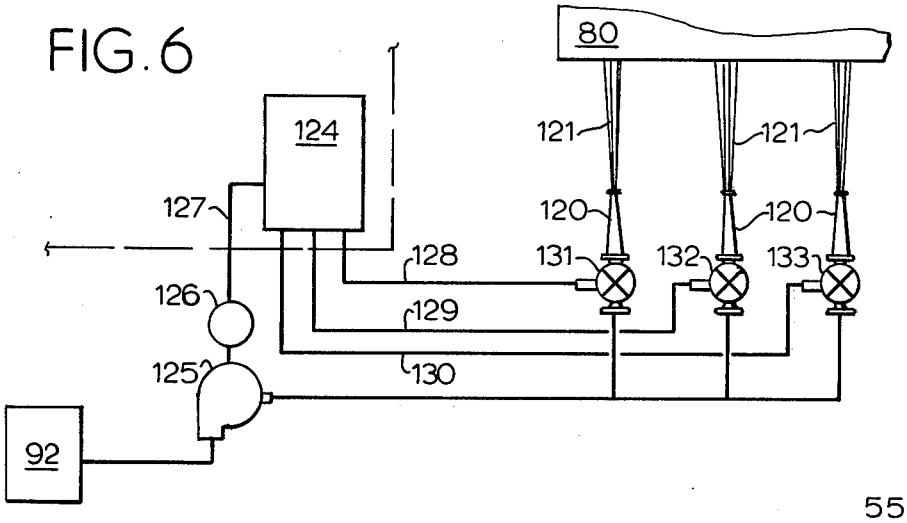
FIG. 11
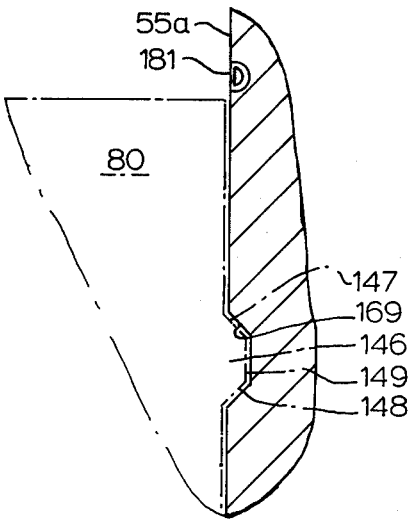
FIG. 17
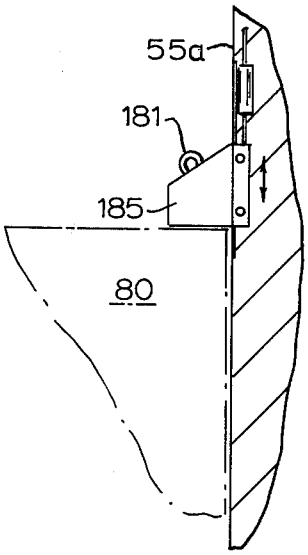

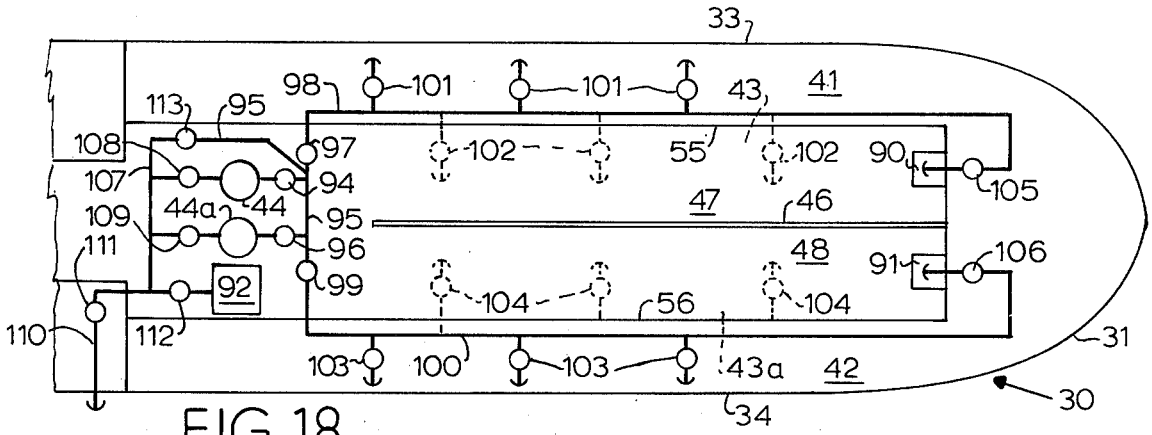
FIG. 18
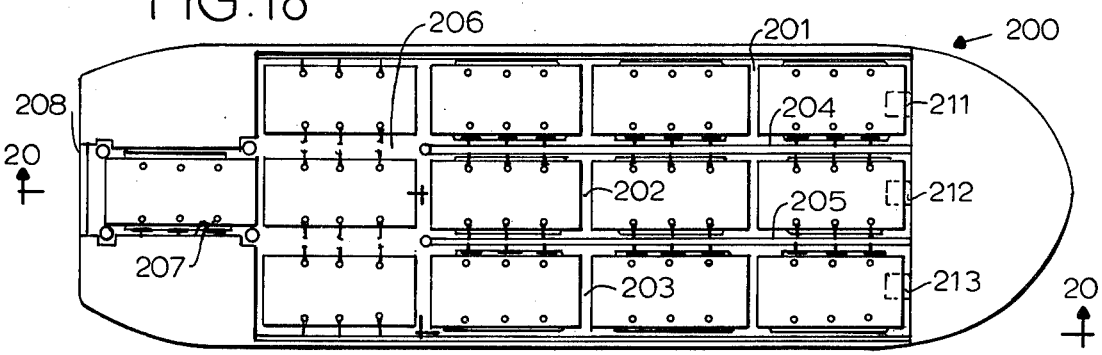
FIG. 19
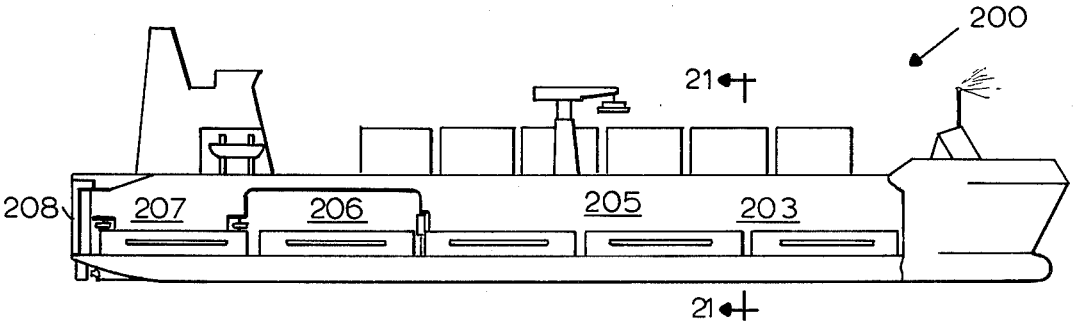
FIG. 20
FIG. 21
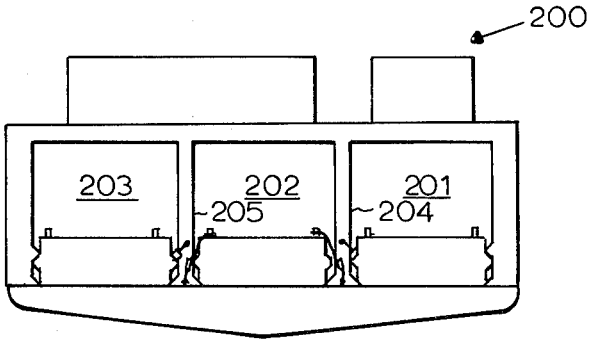

BARGE-CARRYING WATERBORNE VESSEL FOR FLOTATION LOADING AND UNLOADING, AND TRANSPORTATION METHOD

REFERENCE TO RELATED APPLICATION

This application is a continuation-in-part of application Ser. No. 775,936, filed Mar. 9, 1977, which was a continuation-in-part of Ser. No. 701,696, filed July 1, 1976, now abandoned.

BACKGROUND OF THE INVENTION

This invention relates to a barge-carrying waterborne vessel and to a barge-transporting system, as well as to a method for transporting barges across the seas.

In our U.S. Pat. No. 3,913,512, issued Oct. 21, 1975, we describe a vessel which had its primary use in relatively shallow or coastal waters. It employed flotation loading and unloading of barges and utilized transfer of buoyancy from the barges to the vessel in a hold normally kept flooded to the vessel's waterline. The present invention is directed to a flotation-loaded-and-unloaded vessel useful where a substantial width of ocean is to be crossed. In most such instances, it is preferred to pump out the holds so that they are substantially dry, although, if desired, the invention may be used with the hold kept in constant communication with the sea.

It is important for the barges (the term "barges" as used herein is used broadly and includes buoyant cargo carriers which may not strictly be barges in the narrow sense of the word but which are floatable and buoyant cargo carriers capable of flotation loading and unloading) to be retained so that there will be no relative movement between them and the vessel during transport. This enables the phenomenon of transfer of buoyancy, noted in our earlier patent, to be taken advantage of in the event that the hold becomes flooded accidentally, as well as in instances where the hold is flooded throughout the voyage. Such transfer of buoyancy provides the vessel with the ability to sustain damage resulting in accidental flooding of each barge hold, the buoyancy of the barges being transferred to the carrying vessel via a barge-retention or hold-down system. This feature qualifies the carrying vessel for higher seaworthy standards, as designated by marine classification societies. In this connection, the present invention seeks to provide improved method and apparatus for retaining the barges in place in a manner involving a lower initial expense and reduced expense of operation and maintenance.

One of the difficulties encountering any system in which barges are to be transported, is the expense of loading and unloading. As already indicated, the present invention, like that of the issued U.S. Pat. No. 3,913,512, provides flotation loading and unloading through a gate in the vessel. However, the present invention also provides for movement of the barges within the vessel to be accomplished by utilizing the flow of seawater in the hold. The flow is away from the gate during the loading and toward it during unloading. This novel system enables the lowering of both capital expense and the expense of operation and maintenance.

For some types of operation it is desirable to have a plurality of barge-receiving holds. To some extent, this has already been shown in our U.S. Pat. No. 3,978,806, which issued Sept. 7, 1976, but here again the present invention provides an improved type of plural-hold construction. Two kinds of systems are provided, one in which the holds are completely separate and have separate gates (as in U.S. Pat. No. 3,978,806), which enables the vessel to carry barges or pontoons of any length, up to and including the full length of the barge hold and thereby to render a type of service which cannot be rendered by other types of barge-carrying vessels. In the other system there is only one gate, having approximately the width of one of the holds; this latter system includes a transfer arrangement by which the barges are moved laterally into one or another of the holds. This is combined, of course, with the novel system of using water flow for fore-and-aft movement.

Thus, among the objects of the present invention are these: to provide an improved system employing flotation loading and unloading in which water flow is used for moving the barges inside the vessel; to provide a novel type of plural hold system; to provide a novel retention means or hold-down system; and to provide an improved and less expensive over-all barge transportation system and a novel method of operation.

The invention also seeks to provide an improved type of barge which can be mated with the barge-carrying vessel to enable an extraordinarily simple and effective means of retaining the barges in place in the vessel's hold.

SUMMARY OF THE INVENTION

The invention comprises a vessel having side walls providing a series of buoyancy compartments and a hollow interior defining at least one longitudinal hold. The invention calls for means for flooding the hold before any barge-loading gate is opened, so that the water in the hold is equalized with the waterline of the vessel and then, at that time, a gate, preferably in the stern end of the vessel, may be opened for flotation loading or unloading.

Inside the hold is barge-moving means, comprising a flow-creating system for causing sufficient flow of water to move the barges inside the hold in one direction during flotation loading and in the opposite direction during flotation unloading. This may be done by providing a sump, which is in the forward end of the hold when the gate is in the stern and is in the aft end if the gate were to be in the bow. The sump may be used in connection with a sea chest to provide the flooding means, and it may be used in combination with one of the pumps provided primarily for the buoyancy compartments to cause the water to flow forward through the hold for flotation loading through a stern gate and to flow toward the stern gate for flotation unloading.

There may be more than one longitudinal hold, and, if so, flotation loading and unloading and the water flow system are still used. There may be a simple two-hold structure with separate gates, or there may be a single stern gate supplying the barge entrance to two or three holds located side by side. In that event, the longitudinal bulkheads that separate the holds are provided, preferably somewhere near the stern, with an archway for providing a passageway for barges to move laterally into one hold or the other. Water jets may be played against the sides of the barges to help accomplish this lateral movement.

The invention also calls for a plurality of rollers, some quite near the stern gate to aid the entry of barges into the vessel and their departure from it. There may be rollers in pairs with the rollers to one side of the loading bay powered and those to the other side being spring-urged idler rollers. There may also be a power roller or rollers adjacent or at the transfer area where barges are to be moved laterally.

The novel retention system of the invention may take any of several types of embodiments. In one such embodiment, the barges provided for use with the vessel are themselves equipped with a trapezoidal rib or ribs along each side, having a sloping upper face, a sloping lower face, and a vertical outer face. The ship hold may then be provided with a similarly shaped trapezoidal fender having a lower surface which engages the upper face of the barge's rib after the hold has been purged out and the barge has settled on the bottom of the hold. The opposite side of the hold, which may be somewhat wider than the barge, is provided with a sloping lower portion that helps the barge to settle in toward the fender and to lock the rib under the fender when the water is pumped out of the hold. On this other side of the barge, a positive retention or hold-down device may then be applied, cooperating with the rib-fender engagement to lock the barge in place in the hold.

In one form of the invention the retention device comprises a telescoping assembly mounted in a recess in the side wall of a longitudinal bulkhead of the vessel, and preferably acting at an angle thereto. The telescoping member may be extended or retracted by an hydraulic, mechanical, or electrical device so that its outboard end is urged against the side of the barge opposite from the trapezoidal rib and fender engagement.

Another retention device incorporates a flexible linear device, a rod or cable or chain, which may be anchored to the barge as by bitts on the upper surface of the barge, and to the ship hold by a hook and anchor engagement. In vessels having a transfer area, such a cable, chain, or rod device is preferably used on both sides, since there is no practical possibility there of obtaining a rib-fender engagement. The cable, chain, or rod may include a take-up device, such as a turnbuckle or ratchet arrangement for matching its length to the length which it must span, so that it will be taut and the barge held snugly in place.

A cable or chain with a take-up device may also be used to retain standard barges having no bitts by locking one end of the chain or cable to a pad-eye on one side of the hold and then anchoring it to the other side of the hold.

These and other features of the invention will be better understood from the following description of some preferred forms of the invention. From this description other objects and advantages of the invention will also become apparent.

BRIEF DESCRIPTION OF THE DRAWINGS

In the drawings:

FIG. 4 is an enlarged fragmentary view of the transfer area, along the line 4—4 in FIG. 2 and showing drive roller assemblies at each end thereof.

FIG. 6 is a diagram of the water jet system, including controls and pumps.

FIG. 11 is a fragmentary view in section corresponding to the right-hand side of FIG. 8, showing a modified form of rib-receiving structure, incorporating a trapezoidal recess in the hold wall.

FIG. 17 is a fragmentary view in elevation of yet another barge-retention device for ordinary barges.

FIG. 18 is a plan view diagram showing a flooding and waterflow system for use in the vessel of FIGS. 1 and 2.

FIG. 19 is a top plan, somewhat diagrammatic view, of another vessel embodying the principles of the invention, in which there are three holds with a transfer system.

FIG. 20 is a somewhat diagrammatic view in section taken along the line 20—20 of FIG. 19

FIG. 21 is a view in section along the line 21—21 in FIG. 20.

DESCRIPTION OF SOME PREFERRED EMBODIMENTS

The dual-hold vessel of FIGS. 1-18: (General description)

Figures 1, 2, 3, 5:
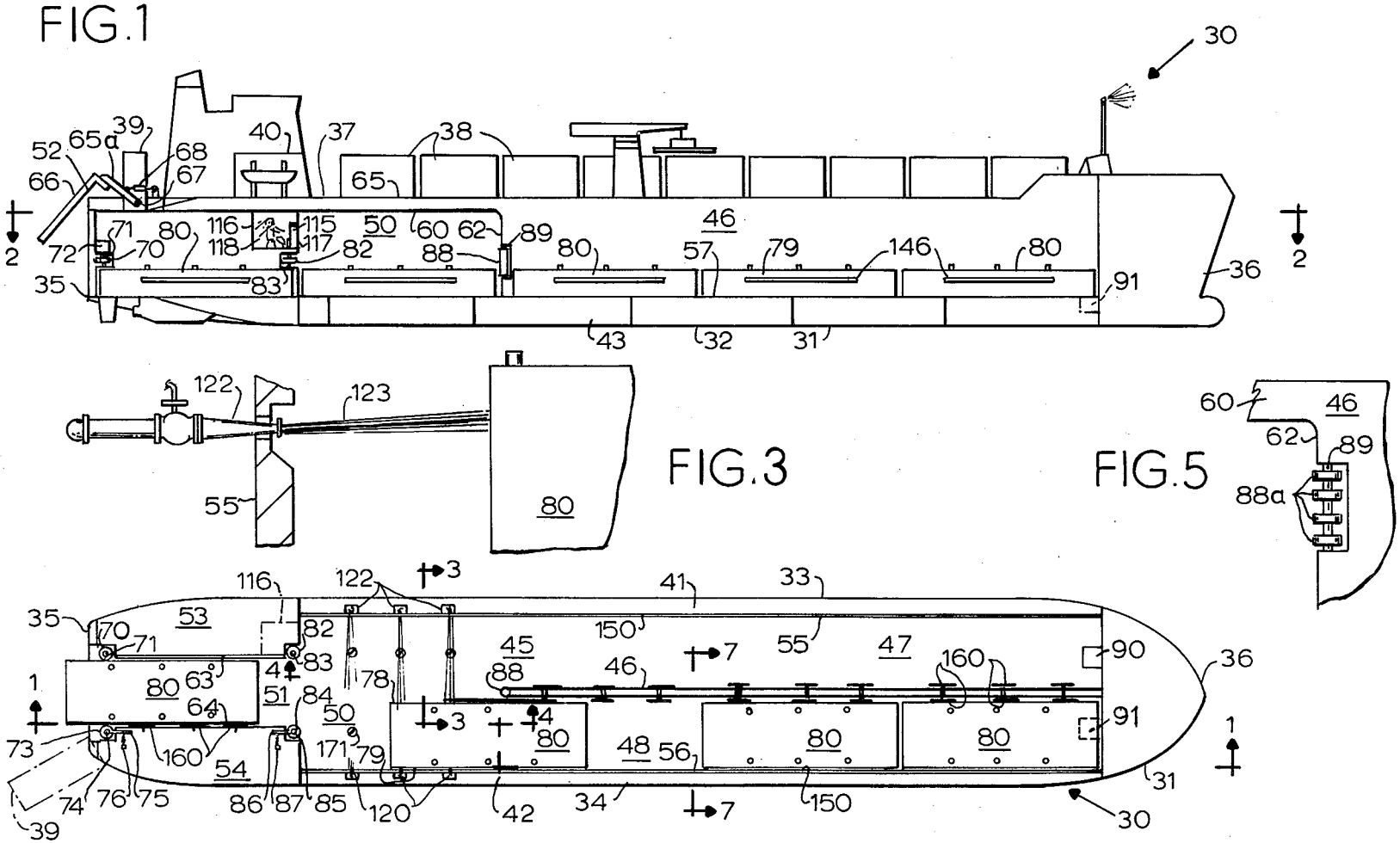
FIG. 1 is a somewhat diagrammatic view in side elevation and in section of a vessel embodying the principles of the invention. The view is taken along the line 1—1 in FIG. 2.
FIG. 2 is a plan view in section of the vessel of FIG. 1, taken along the line 2—2 in FIG. 1 and showing that this form of the invention comprises a vessel having two longitudinal holds with a transfer area and a loading bay. The vessel is partially loaded with barges, and jets of water are impinging upon one barge to shift it laterally.
FIG. 3 is an enlarged fragmentary side view, partially in section taken along the line 3—3 in FIG. 2 of one of the jet nozzles of FIG. 2 and adjacent area.
FIG. 5 is a more fragmentary view showing a modified form of transfer for roller assembly at the forward end of the transfer area.
Figure 7:
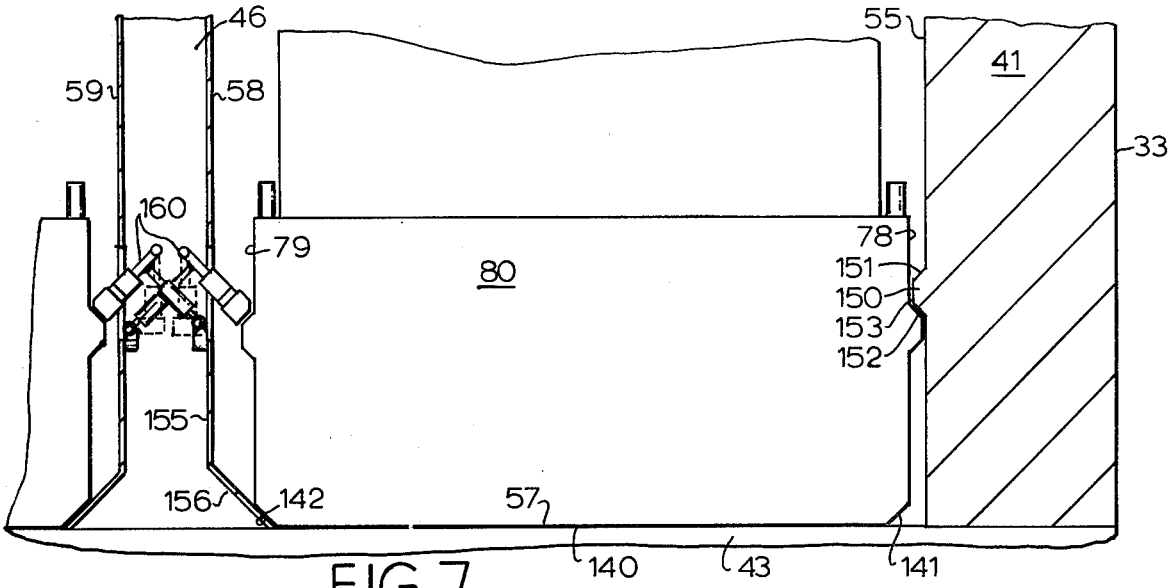
FIG. 7 is an enlarged fragmentary view in section taken along the line 7—7 in FIG. 2 and showing one form of barge-retention system.
Figure 8:
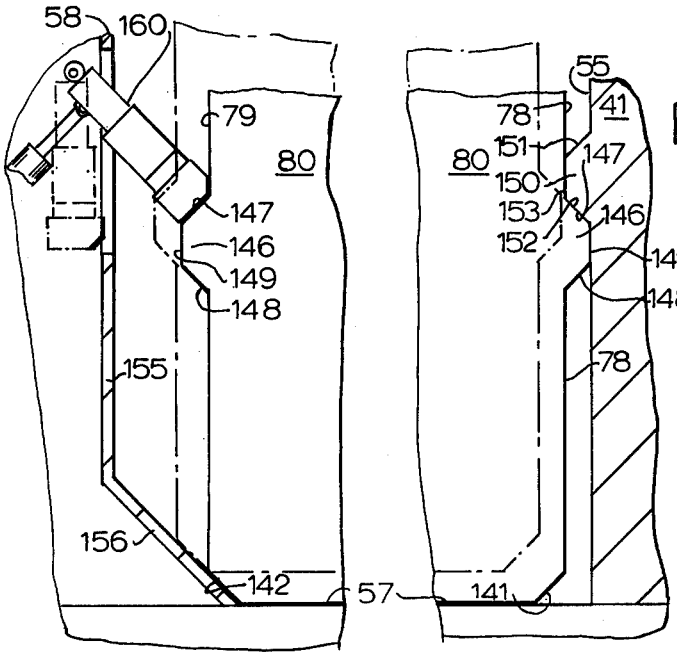
FIG. 8 is a still further enlarged view of portions of FIG. 7 and broken in the middle to conserve space. A floating position of the barge is shown in broken lines, so that it may be seen how it settles into place while moving to one side so that its rib is locked under the fender in the hold.
Figure 9:
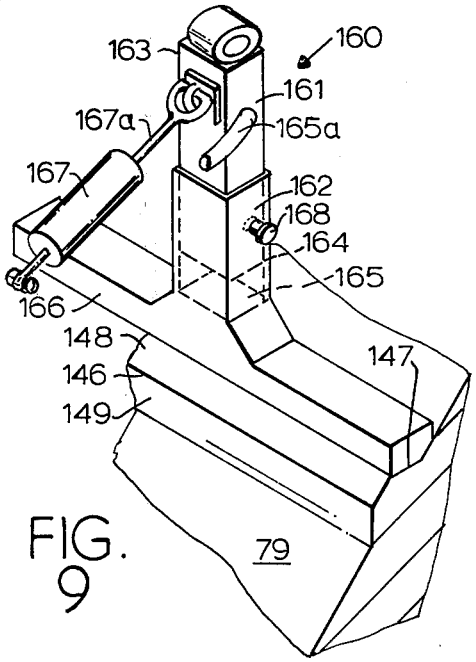
FIG. 9 is an enlarged isometric view of one of the telescoping retention members of FIGS. 7 and 8.
Figure 10:
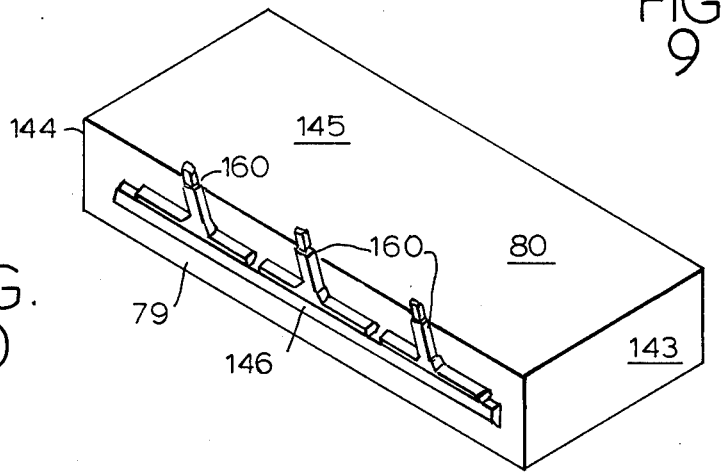
FIG. 10 is an isometric view in perspective of a barge made for use with that retention system, showing its rib engaged by three members of structure of FIG. 9.
Figure 12:
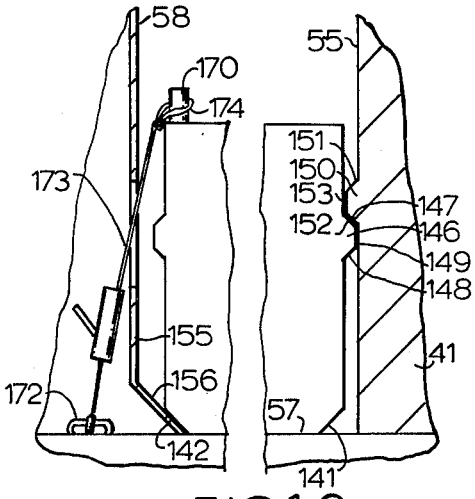
FIG. 12 is a view similar to FIG. 8, though on a smaller scale, another type of retention device incorporating a flexible linear member, used in combination with the ribfender engagement.
Figure 13:
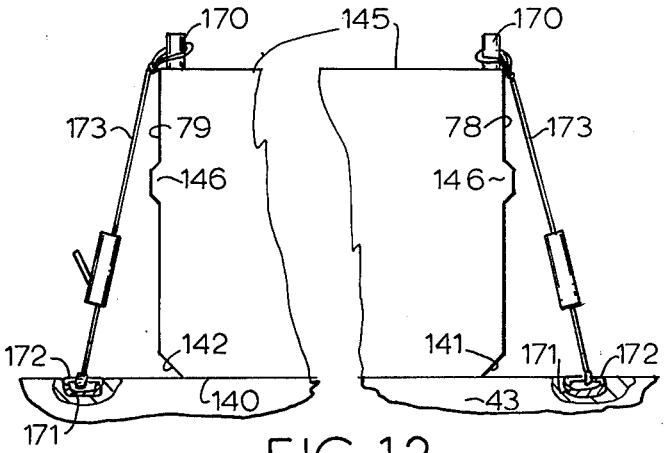
FIG. 13 is a fragmentary, broken, end view, partly in section, showing cables used as retention means on both sides of a barge in the transfer area of FIG. 2.

FIGS. 1 and 2 show, somewhat diagrammatically, a dual-hold vessel 30 which illustrates many of the points of the invention.

The ship or vessel 30 has a hull 31 with a bottom wall 32, a port-side wall 33, a starboard side wall 34, a stern end 35, and a bow end 36. The ship has a deck 37 which is preferably imperforate, and therefore can be made strong at low expense and can support a number of cargo containers 38, which may be loaded on by a roll-on, roll-off ramp 39. The ship 30 may include superstructure 40, providing a pilothouse, crew quarters, galley, etc. The port-side wall 33 forms part of a series of port ballast tanks 41, while the starboard wall 34 forms part of a series of starboard ballast tanks 42. Similarly, the bottom wall 32 forms part of a series of bottom ballast tanks 43. These ballast tanks 41, 42, and 43 are provided with a suitable pump or pumps 44 which are made use of in a novel way in the present invention in addition to their normal use in connection with the ballast tanks.

The vessel 30 is unusual in that below the deck 37 almost the entire vessel comprises a hollow interior 45 devoted to hold space and divided by a longitudinal bulkhead 46 into two non-compartmented holds, a port hold 47 and a starboard hold 48. Immediately aft of the bulkhead 46 is a transfer area 50 and aft of that is an entrance bay 51 adjoining a gate 52. Engine rooms 53 and 54 are provided near the stern 35, one on each side of the centrally located entrance bay 51. The port hold 47 lies between the bulkhead 46 and a wall 55, which may be a wall of the ballast tanks 41, while the starboard hold lies between the bulkhead 46 and a wall 56, which may be a wall of the ballast tanks 42. The holds 47 and 48 have a strong bottom wall 57. The bulkhead 46 may be hollow with two walls 58 and 59.

Above the transfer area 50 is an archway 60 extending from the aft end 62 of the bulkhead 46 to bulkhead structures 63 and 64 that separate the entrance bay 51 from the engine rooms 53 and 54. Deck support structure 65 extends between the port and starboard side walls 33 and 34 and the bulkheads 50, 63, and 64 and the archway 60. As shown in FIG. 1, the stern gate 52 may be generally L-shaped having an upper normally horizontal portion 65*a* and a normally vertical portion 66. The horizontal portion 65*a* may be pivoted by a pivot shaft 67 to the ship's structure so that the stern gate 52 may be raised by power means 68 in a normal manner about this pivot shaft 67 to open the entrance bay 51 to the sea.

Below the engine rooms 53 and 54 are located the driving propellers and rudders for propelling and guiding the ship 30.

The barge-propelling rollers in the entrance bay 50 (FIGS. 1, 2, 4, and 5)

On one side of the entrance bay 51, closely adjacent the stern gate 52, is mounted a drive roller 70 on a vertical shaft 71 and provided with a power drive 72. Opposite the roller 70 is an idler roller 73 on a vertical shaft 74, and the shaft 74 is carried by one or more pivot arms 75, urged outwardly by a spring 76. The rollers 70 and 73 lie just above the ship's waterline during flotation loading and unloading. The spring 76 helps to assure that both rollers 70 and 73 will make contact with the side walls 78 and 79 of a floating barge 80 being moved into the ship 30, and the power-driven roller 70 supplies part of the motive power required to cause the movement of the barge further into the loading bay 51 and into the transfer bay 50. At the transfer bay end of the loading bay 51, another driven roller 82 is provided on a vertical shaft 83 and on the opposite side another idler roller 84 on a shaft 85 is provided, the shaft 85 being mounted in a pivot assembly 86 to swing outwardly as urged by a spring 87. Another driven roller 88 is provided on the aft end 62 of the bulkhead 46 for engagement by the front end of a barge 80; to assure contact when the front end of the barge is raked, the roller 88 may be cylindrical, or there may be a series of smaller wheels 88*a* on a common shaft 89 (FIG. 5).

The water flooding and barge-moving water flow system (See especially FIG. 18)

At the forward end of the port hold 47 is a sump 90, and at the forward end of the starboard hold 48 is a sump 91 (FIG. 18). Each sump 90 and 91 is connected by suitable valves to a suitable pump 44 or 44*a* and is also connected by suitable valves to a sea chest 92. The pump 44, as shown in FIG. 18 is connected by a valve 94 to a conduit 95, to which the pump 44*a* is also connected by a valve 96, so that crossover operation can be obtained when needed or desired. The conduit 95 is connected by a valve 97 to a conduit 98 and by a valve 99 to a conduit 100. The conduit 98 is connected to the port buoyancy compartments 41 by valves 101 and to the port-side bottom buoyancy compartments 43 by valves 102. Similarly, the conduit 100 is connected to the starboard buoyancy compartments 42 by valves 103 and to the starboard-side bottom buoyancy compartments 43 by valves 104. This is normal for such a type of ship.

In the present invention, the large-volume, low pressure pumps 44 and 44*a* and the conduits 95, 98, and 100 are utilized to provide the loading and unloading water flow by extending the conduits 98 and 100 forward and by connecting them, respectively, by valves 105 and 106 to the sumps 90 and 91. Thus, with the valves 99, 101, and 102 closed and the valves 97 and 105 open, either or both pumps 44 and 44*a* may be connected to the sump 90 by use of the valves 94 and 95. Similarly, the valves 97, 103, and 104 may be closed and the valves 99 and 106 opened, for use of either or both pumps 44 and 44*a* in connection solely with the sump 91.

To complete the flow system, the pump 44 is connected to a conduit 107 by a valve 108, and the pump 44*a* is connected to the conduit 107 by a valve 109. An overboard discharge line 110 is connected to the conduit 107 by a valve 111, for pumping out water. The sea chest 92 is connected to the conduit 107 by a valve 112, and, finally, the conduit 107 is connected via a valve 113 to the conduit 95.

All the valve controls for all valves may be centralized in one location, such as a console 115 in a control room 116 shown in FIG. 1 as just aft of the transfer area 50, where direct observation of that area may be obtained through a window 117 and direct observation of the entrance bay 51 may be obtained through a window 118. Closed circuit television may be used to afford the operator observation of any other desired locations, as along the holds 47 and 48.

Control of the buoyancy chambers 41, 42, and 43 is normal and also apparent from FIG. 18, and need not be described. For flooding the holds 47 and 48, the transfer area 50, and the entrance bay 51 before opening the stern gate 52, to bring water in these places up to the ship's waterline, the valves 94, 96, 108, 109, and 111 are closed, as are the valves 101, 102, 103, and 104. The valves 112, 113, 97, 99, 105, and 106 are open to bring water in through the sea chest 92 at the natural head provided by the ship's waterline being higher than the bottoms of the holds 47 and 48. (If desired, the waterline may have previously been adjusted by admitting or expelling water into one or more of the buoyancy tanks 41, 42, and 43.) Water flows from the sea chest 92 via the conduits 107, 95, 98, and 100 into the sumps 90 and 91 and thus into the holds 47 and 48 and from there to the transfer area 50 and the entrance bay 51. This flow continues until the water inside the holds 47 and 48, the transfer area 50 and the entrance bay 51 reaches the level of the ship's waterline. Then, the stern gate 52 may be opened to afford access to barges 80.

Assume that the holds are empty and that barges 80 are to be flotation loaded into them. The desired water flow pattern into the hold 47 (which it will be assumed here is the first one to be loaded, although the hold 48 could be loaded first) is achieved by closing the valves 113, 112, 99, and 106 and by opening the valves 111, 108, and 94 and then operating the pump 44 to send water from the sump 90, exclusively, to overboard discharge via the conduits 98, 95, 107, and 110. The valves 97 and 105 remain open, and the valves 101 and 102 remain closed. As a result, water flows into the entrance bay 51 through the open gateway and on into the hold 47 and to the forward end of that hold 47 at the sump 90. In still faster flow, the valve 109 and 96 are opened and the pump **44*a* is put into operation. When the hold 47 has been filled with barges 80 (in a manner described later), the water flow from the sump 90 is stopped by closing the valves 97 and 105, and the valves 99 and 106 opened to pump water from the sump 91 overboard by the conduits 100, 95, 107, and 110, so that water flows through the open gateway and via the entrance bay 51 and the transfer area 50 into the hold 48. When the hold 48 has been loaded, the pumps 44 and 44*a*** (if used) are shut down temporarily.

When the vessel 30 is fully loaded with barges 80 (part of such loading being described below), the gate 52 is closed. Then the holds may be dewatered. To do this, the valves 105 and 106 may both be opened, the valves 101, 102, 103, and 104 remaining closed, and the valves 97 and 99 are opened. The valves 113 and 112 remain closed, and the valves 94, 96, 108, 109, and 111 are opened. The pumps 44 and **44*a* may then pump water from the sumps 90 and 91 overboard by the conduit 110 to remove substantially all the water from the holds 47 and 48 and from the transfer area 50 and entrance bay 51**.

Lateral transfer by water jets (FIGS. 1–6)

As stated above, the rollers 70 and 74 initiate movement of the barges 80 into the hollow interior 45, at the entrance bay 51, and the rollers 82 and 84 act with the forward water flow toward either sump 90 or 91 to move the barges 80 forward through the entrance bay 51 and into the transfer area 50. Also, as indicated above, the water flow carries the barges 80, after lateral transfer, forward in the hold 47 or 48 to which they have been laterally transferred. Now the transfer itself is dealt with. A series of water-jet nozzles 120, located above the ship's waterline in the starboard wall 56 of the transfer bay 50, send jets 121 of water against the starboard side wall 79 of a barge 80, tending to move the barge 80 toward the port-side wall 55 of the transfer bay 50. Meanwhile, a series of identical water-jet nozzles 122 in the port wall 55 send jets 123 of water against the port wall 78 of the barge 80, tending to move the barge 80 toward the starboard side wall 56. Both series of jets 121 and 123 are preferably used simultaneously, to achieve better control; but one series of jets is controlled to be more powerful than the other, depending on the described direction of lateral transfer. The rollers 82 and 88 may assist somewhat as does the water flow but lateral transfer is preferably the function of the jets 121 and 123.

FIG. 6 illustrates a control system, only one series of nozzles 120 is shown, but the other side is controlled identically, all by the same console 124, which may be located as part of or to one side of the console 115 in the control room 116. The water for the jets 121 and 123 may be obtained from the sea chest 92 (or from a different one, if desired) by a pump 125 having a motor 126 controlled from the console 124, as by an electrical lead 127. Similar electrical leads 128, 129, and 130 go from the console 124 to solenoid or other types of electrical controls for the valves 131, 132, and 133, which control water flow through each nozzle 120.

Unlike the high-volume, low pressure pumps 44 and **44*a*, each capable of moving 200,000 gallons per minute, the pump 125 is a low volume, high pressure pump, which with the aid of the nozzles 120 and 122 can send relatively low amounts of water at high velocity against the sides 78 and 79 of the barges 80. Each nozzle control valve 131, 132, and 133 may be structured to provide a series—e.g., six different velocities to each of the jets 121 and 123. Thus, the operator in the control room 116 may watch the lateral transfer of each barge 80** directly and control it.

Summary of the flotation loading process (FIGS. 1–6 and 18)

Prior to flotation loading of the ship, the stern gate 52 is closed and the holds 47 and 48 are dry, as are the transfer area 50 and the entrance bay 51. When flotation loading of the barges 80 is to proceed, assuming that the ship 30 is at that time empty, the holds 47 and 48, the area 50 and the bay 51 are flooded, preferably by water coming from the sea via the sea chest 92 into the sumps 90 and 91 and thence into the holds 47 and 48, all as described. This operation is rapid at first due to the head provided since the barge hold bottom 57 is then well below the waterline of the vessel 30. As the flooding proceeds it slows down, as the water inside the holds approaches equalization with the vessel's waterline. When this equalization is achieved, or is substantially achieved, the stern gate 52 may be opened to enable loading. At this time, the connection between the sumps 90 and 91 and the sea chest 92 is cut off, and the pump 44 (and perhaps also the pump **44*a*) is used to pump water out from one of the sumps, e.g., the sump 90 and overboard to provide a flow of water in the hollow interior 45 from the stern 35 to the sump 90. This flow may be substantial, for example, at the rate of two or three hundred thousand gallons per minute, since the pumps 44 and 44*a* supplied for the ballast operation are of a size capable of accomplishing large flow at low pressure. With the stern gate 52** still open and the barges 80 entering, they are guided and partly propelled by the rollers 70 in conjunction with the idler rollers 72 into the entrance bay 51. In it the water flows forward and the rollers 70 and 72 move them forward, and when the barges 80 reach the rollers 82 and 84 they are propelled from the loading bay 51 into the transfer bay 50, partly with the aid of the rollers 82 and 84, and soon abut the transfer roller 88 or 88*a*. Once in the transfer area 50, the barge 80 is impinged upon by the jets 121 and 123 to move it laterally into alignment with the hold 47 (for example), all under control of the operator. The operator can see either directly or with the aid of closed circuit television, all critical points, such as the transfer area, the stern gate area, and the forward ends of the holds 47 and 48, and perhaps other places along the holds. By having several different settings of the valves 131, 132, 133, etc., water can be forced through the nozzles 120 and 122 having various degrees of momentum. During the transfer operation when the barge 80 is in the transfer bay 50 and is to be moved laterally, nozzles 120 and 122 on both sides are in use to help to retain the correct lateral position and evenness, but the nozzle momentum against one barge side wall 79 is much greater than on the other side wall 78, so that the jets 121 and 123 of water playing on the sides 78 and 79 of the barge 80 move it toward the wall 55 of the hold 47, while at the same time the jets 123 are braking that movement, to enable complete control.

Each barge 80, after having been transferred into the hold 47 is moved forwardly in the hold 47 by water flow, normally until the hold 47 is filled. When that particular hold 47 is filled, loading is then directed into the other hold 48, and this is done by shutting off the pump 44 (or 44*a* or both) from the sump 90 and applying it to pump water out from the sump 91. There is no tendency of the vessel 30 to list at this stage, because the barges 80 are freely floating on water and not bearing on the vessel 30.

When the two holds 47 and 48 are both fully loaded with barges 80, then one barge 80 may be left in the transfer area 50, preferably centrally with respect to it, and another barge 80 may be put into the entrance bay 51 and left there. The stern gate 52 is then closed, and the pump 44 or pumps 44 and 44*a* are used to dry out the holds 47 and 48 and at the same time, of course, the bay 51 and the area 50. As this is done the barges 80 are lowered in the barge holds 47 and 48 and soon engage the bottom 57. An important part of the invention is to retain the barges 80 against relative movement between them and the ship 30. This may be accomplished in any of several ways, which will now be described.

One form of retention means (FIGS. 7–10)

The system of FIGS. 7–10 makes use of a novel barge structure. For example, the barge 80 may be generally shaped as a rectangular parallelepipedon, having, in addition to side walls 78 and 79 a flat bottom 140 joined to the walls 78 and 79 by splayed or sloping bilges 141 and 142. Both front and rear walls 143 and 144 may be vertical. They also have a substantially flat upper surface 145. The novelty of the barge 80 lies in the fact that both its side walls 78 and 79 are provided with a rib or fender 146. Preferably there is one continuous rib 146 on each side, extending for a substantial length along the side wall 78 or 79 but not necessarily for the complete length. Each rib 146 is generally trapezoidal in shape having a downwardly sloping upper surface 147, a downwardly sloping lower surface 148, and a flat vertical surface 149.

The barge structure is mated to structure in the ship. For example, the outer wall 55 of the hold 47 may be provided with a fender 150, preferably trapezoidal in shape with a sloping upper wall 151 to help guide the barge 80 down, a sloping lower surface 152, and a vertical surface 153. When the barge 80 rests directly on the bottom 57 of the hold 47, the surface 152 of the fender mates with the upper surface 147 of the rib 146. The opposite wall, which may be one wall 155 of the bulkhead 46, which may be hollow, is preferably provided with a lower sloping portion 156 to help guide the barge 80 down and also toward the wall 55 as the water is pumped out from the hold 47. The hold 47 is made enough wider than the barge 80 to accommodate this sidewise movement; for example, the hold 47 may be about a foot or a foot and one-half wider than the barge 80.

As the barge 80 settles down and simultaneously moves laterally, the rib 146 gets below the trapezoidal fender 150, its upper surface 147 engaging the fender's lower surface 152. When the barge 80 is bottomed, the rib's surface 149 either is in contact with or closely adjacent to the wall 55. When the hold 47 is again flooded, the barge 80 tends to float out of that position. However, during the voyage, it is not permitted to do so, because a suitable securing means is provided.

For this purpose the hollow bulkhead 46 may accommodate a telescoping retention device 160. This may comprise a hollow elongated inner prism member 161, for example, square in cross-section, and a similarly shaped outer prism member 162 arranged to slide relatively to the inner prism 161. Suitable actuating means may be hydraulic, pneumatic, mechanical, or electrical. For example, the inner prism 161 may have a closed upper end 163 and an open lower end 164, while the outer prism 162 may have a closed lower end 165. A fluid conduit 165*a* may enter the upper end of the inner prism 161, so that the two members 161 and 162 may be hydraulically or pneumatically extended and retracted. In any event, the purpose is to be able to withdraw the retention device 160 so that it will not interfere with the downward settling into place of the barge 80 and then can be projected out so that it will engage the barge 80. For this purpose it preferably has an outer end portion 166 of substantial length which engages the upper surface 147 of the rib 146, and which may be splayed to engage also a portion of the barge wall 79. When, for example, three of these devices 160 are in place against a 100-foot long barge so they serve to retain it positively and accurately in position and to enable transfer of buoyancy when the hold 47 is flooded.

Stowage and retention of barges 80 in the hold 48 is symmetric to that first described. The rib-fender engagement secures one side, and the device 160 the other. Hence, powered device 160 need be used only along one side. Moreover, a pneumatic or hydraulic cylinder 167 with its piston rod 167*a* swiveled to the inner prism 161 and itself swivel-mounted to the bulkhead 46 enables retracting into or projecting the device 160 from the hollow bulkhead. A mechanical lock 168 is provided for securely retaining the device 160 in position when the fluid pressure system is turned off during sea transit.

The modified retention means of FIG. 11

FIG. 11 shows a wall 55*a* which, instead of a fender 150 has a trapezoidal notch 169 to engage the rib 146. Operation is substantially the same otherwise.

The flexible retention means of FIGS. 12–15

Other types of retention or hold-down devices may be used, including those shown in some of our previous patents, such as in U.S. Pat. Nos. 3,913,512 and 3,978,806. Yet another form of retention means is shown in FIGS. 12–15. These may be used in place of the devices 160 already described or may be used along with those in certain locations, such as retaining the barge 80 in the transfer area 50.

For use of this device, the barge 80 is provided on its upper surface 145, and preferably near each side edge, with a series of bitts 170 which project upwardly. Similarly, the transfer area 50 or hold 47 or 48 is provided preferably at the bottom 57 with a series of sockets 171 having an anchor bar 172 therein. The sockets 171 may be recessed into the bottom 57. If located inside the hollow bulkhead 46, such recessing is unnecessary.

The bitts 170 and the sockets 171 are used in conjunction with a linear member 173 which may be flexible, as for example a wire cable or a chain, or may be rigid, as for example a rod. At one end there is a loop 174 or other suitable member for attachment to the bits 170; at the other end there is hook 175 or other suitable member for attachment to the anchor arm 172. In any event, it is desirable to provide a quick-acting take-up device 176 provided. This may be hydraulic or mechanical. It may be a turnbuckle or a rack and pinion arrangement or a cylinder piston arrangement, as shown, with a piston rod 177, a cylinder 178, and a control lever 179, which in any event, acts quickly to lengthen or shorten the length of the linear member 173 so that it will extend between the bitt 170 and the anchor 172 and can be made taut when in place. In this way, the barge 80 in the transfer area 50 can be secured in place on both sides by these linear members 173. If desired, they may be used to secure all of the other barges 80 in place, in cooperation with the rib-fender engagement (See FIG. 12). These devices are less expensive than the devices 160 but require hand affixation, while the devices 160 can be remote-controlled, as from the control room 116.

Figure 16:
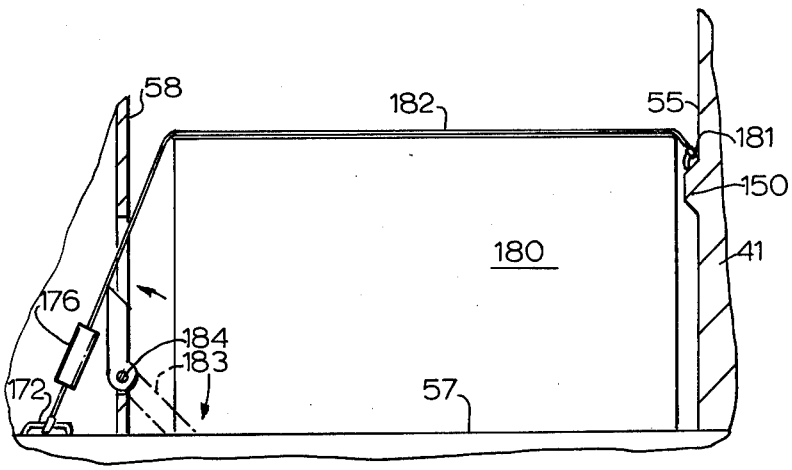
FIG. 16 is a view somewhat similar to FIG. 8 of still another barge-retention system employing a flexible linear member such as a cable, used with a barge not having any rib.
Figure 15:
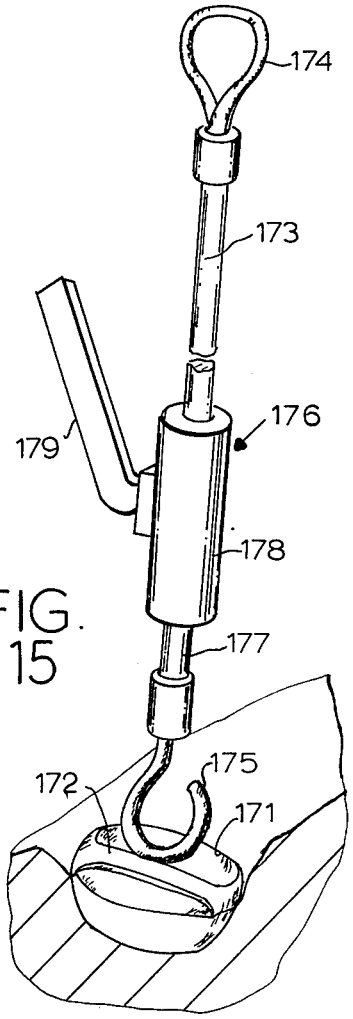
FIG. 15 is a view in perspective, partially broken of a cable type of retention member, as used in FIGS. 12–14, in conjunction with a recessed anchor in the hold.
Figure 14:
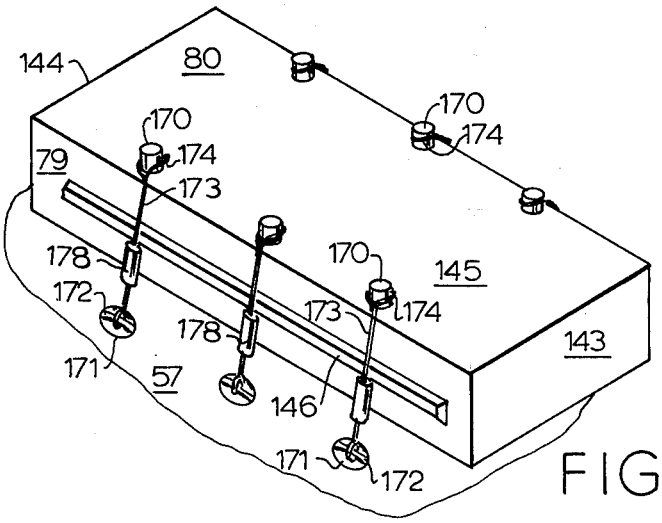
FIG. 14 is an isometric view of the barge and retention means of FIG. 13, showing part of the hold and anchor.

The hold-down systems of FIGS. 16 and 17

The vessel 30 of this invention is usable not only with special barges 80 made for the purpose but also with miscellaneous types of other or standard barges 180 having neither the ribs nor the bitts shown. These barges 180 may have bitts 170 or ribs 146 or both secured to them if so desired, but if they are used in other inconsistent environments they may not be so desired. For that reason the structure of FIG. 16 is given as one example of how to retain barges 180 in place. Other examples of suitable hold-down means are shown in U.S. Pat. Nos. 3,913,512 and 3,978,806. In this modification of the invention the fender 150 has no real function, and if the vessel 30 is never to be used with barges like the barges 80, the fender 150 may not be present. Whether it is or not, a pad-eye 181 may be provided for cooperation with an elongated cable or chain 182 having a take-up device 176. The elongated flexible member 182 is like the member 173 except for length and the necessity that it be flexible. Slope, useful when barges 80 are used, may be provided by a series of sloping members 183, pivoted on pins 184, rather than the sloping wall 156. The members 183 may be swung up when using barges 180 and down for barges 80.

Pad-eyes 181 for such anchorage are also shown in FIGS. 11 and 17.

In FIG. 17 vertically movable retention members 185 are shown from on either one or both sides, with or without use of cables or chains 182.

Flotation unloading of barges 80 from the ship 30

In unloading the system, the retention means 160 or 173 are loosened so that the barges 80 are free, water is let into the holds 47 and 48 by connecting the sea chest 92 to the sumps 90 and 91, and when the water in the holds 47 and 48 is approximately level with the ship's waterline, the stern gate 52 is opened. Water is pumped into the sump 90 to cause water flow toward the stern. The barge 80 in the loading bay 51 is, of course, unloaded first, aided by the rollers. Then the barge 80 in the transfer area 50 is unloaded. Then, one by one, the barges from the hold 47 are transferred by the water jets 121 and 123 and then unloaded. When the hold 47 is fully unloaded, the water flow in that hold is cut off, and water is pumped in the sump 91 of the hold 48. The water jets 121 and 123 are connected for proper transfer, and unloading proceeds. When unloading is completed, the flow of water into the sump 91 is cut off, and the gate 52 may, if desired, be closed; or at that time other barges may be flotation loaded into the ship. Complete unloading or full loading is not required.

A three-hold vessel (FIGS. 19–21)

Basically similar in principle but different in details is the three-hold vessel 200 shown in FIGS. 19–21. Its three longitudinally-extending holds 201, 202, and 203 are separated by bulkheads 204 and 205 like the bulkhead 46. There is a transfer area 206 and a loading bay 207 provided with a stern gate 208. The arrangement of machinery is substantially as before, and so are all the other features including the ballast tanks and the pumping system. In this instance, there are three sumps 211, 212, and 213 all located at the forward end of their respective holds 201, 202, and 203. Once again, they are connected as by a sea chest to the ocean and, as by the ballast pump 44, can be driven in either direction. The barge-retention system may be exactly as described in either FIGS. 4–7 or FIGS. 8 and 9. In this form of the invention the vessel is loaded in any convenient manner utilizing the transfer bay. Thus, either the center hold 202 may be loaded first or last or intermediately; either side hold 201 or 203 may be loaded before the other one is loaded. The flow of water is as before and so are the roller systems. The transfer to side-by-side is accomplished by the water jets until the side holds 201 and 203 are filled with barges. The center hold 202 is also filled with barges, the jets associating in centering them through the transfer area. Then one barge is placed in line with either side hold 201 or 203 by the jets. Another barge may be placed in line with the other side hold by use of a winch, and a third barge is left in the center. Unloading is done in the same basic manner in reverse order.

Figure 22:
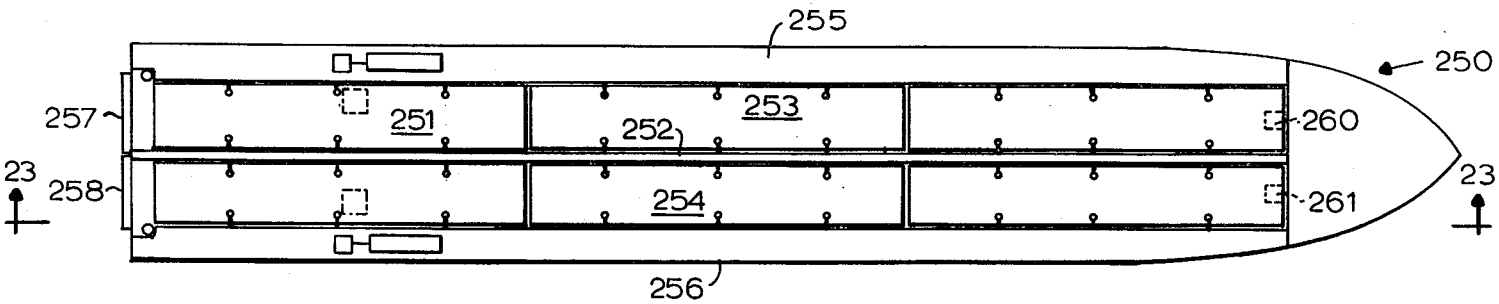
FIG. 22 is a somewhat diagrammatic view similar to FIG. 2 of another modified form of the invention having two separate longitudinal holds divided all the way by a longitudinal bulkhead with separate gates at the stern for each hold.
Figure 23:
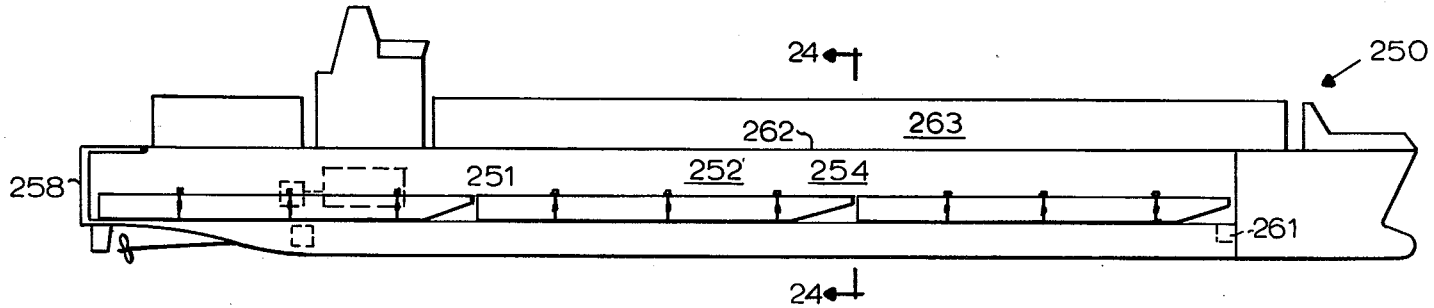
FIG. 23 is a somewhat diagrammatic view in section taken along the line 23—23 in FIG. 22.
Figure 24:
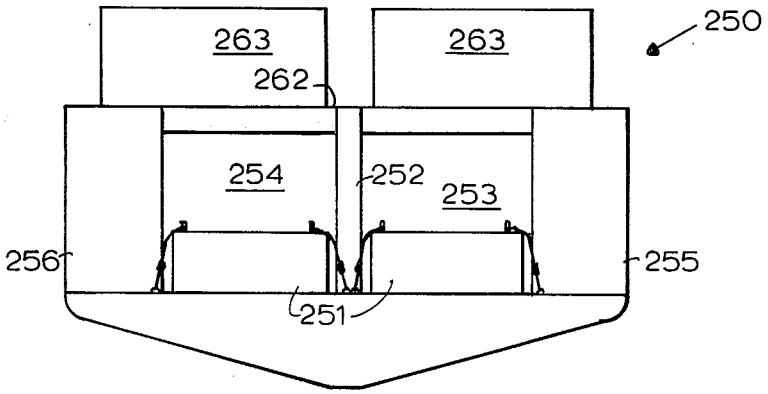
FIG. 24 is a view in section taken along the line 24—24 in FIG. 23.

A dual-hold structure for very large barges (FIGS. 22–24)

A vessel 250 shown in FIGS. 22–24 is able to accommodate very large barges 251, such as those used in the Mississippi River or any large European rivers, including the Rhine and the Danube. These barges 251 may be approximately 200 feet long, and that length is probably not practical for a stowage in a ship of the type in which the barges must undergo lateral transfer, since that would make the archway very long. (However, it should be noted that the ship 30 of FIGS. 1 and 2 can accommodate one such long barge 251, which would then occupy both the entrance bay 51 and the transfer area 50 and would be the last barge to be loaded and the first to be unloaded.) Similarly, the three-hold ship 200 can accommodate such barges 251, but only in the center hold 202 and, of course, in the entrance bay and transfer area. However, when nothing but such large barges 251 are to be transported, another expedient is desirable. The same types of barge retention means are again applicable, and so are the novel water-flow loading system and the initial rollers.

In this instance, the vessel 250 has a center bulkhead 252 extending substantially the entire length of the vessel and dividing it into two holds 253 and 254. It will be noted that the side wall structure and buoyancy tanks 255 and 256 are substantially wider. Part of this is due to the fact that the propelling means will be at the sides, and so the vessel 250 must be wider there.

An important feature of this particular modification of the invention is the fact that each hold 253, 254 is separate from the other and has its own separate stern gate 257 or 258. The structure of the two gates may be the same. Each hold also has a sump 260, 261 at the opposite end of the hold from the gate 257, 258 and connected in the same manner as that already described. It is usually better to load one hold 253, 254 at a time, but this is, of course, not strictly necessary except to prevent the danger in unquiet water of the barges 251 bouncing against each other at the entrances to the stern gates 257, 258. As will be seen, the vessel 250 can accommodate a series of these barges 251 and can hold them down in the manner shown in FIG. 16, or any other suitable type of retention means, Similarly, the deck 262 being imperforate and strong, can be loaded with additional cargo 263.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

We claim:

1. A barge-carrying waterborne vessel including in combination:

a hull with rigid supporting and hull-reinforcing structure, a bow, a stern, and side walls providing a series of buoyancy compartments, said hull having a hollow interior defining at least one longitudinal hold extending most of the length of said vessel, flooding means for putting water into said hold to the depth of the vessel's waterline, gate means at one end of said vessel for flotation loading and unloading of said hold, when said hold is flooded, with a plurality of barges, barge-retention means in said hold for holding each said barge down against the bottom of a said hold, for preventing movement of the barges, and for enabling exchange of buoyancy between each said barge and said vessel when said hold is flooded, opening and closing means for opening and closing said gate means so as to enable said flotation loading and unloading, and barge-moving means in said hollow interior comprising flow-creating means for causing flow of water to move barges in said hold in one direction during flotation loading and in the other direction during flotation unloading.

2. The vessel of claim 1 wherein there is a plurality of said longitudinal holds separated by longitudinal bulkhead means, said gate means comprising a separate gate for each said hold.

3. The vessel of claim 1 wherein there is a plurality of said longitudinal holds separated by longitudinal bulkhead means, said gate means comprising a single centrally located gate, and said bulkhead means providing a lateral passageway between adjacent holds.

4. The vessel of claim 3 wherein said hollow interior provides as part of said barge-moving means, lateral jet means facing said lateral passageway for causing impingement of water jets upon the sides of a barge to move it laterally in said passageway.

5. A barge-carrying waterborne vessel including in combination:

a hull with rigid supporting and hull-reinforcing structure, a bow, a stern, and side walls providing a series of buoyancy compartments, said hull having a hollow interior defining at least one longitudinal hold extending most of the length of said vessel, flooding means for putting water into said hold to the depth of the vessel's waterline, gate means at one end of said vessel for flotation loading and unloading of said hold, when said hold is flooded, with a plurality of barges, barge-retention means in said hold for holding each said barge down against the bottom of a said hold, for preventing movement of the barges, and for enabling exchange of buoyancy between each said barge and said vessel when said hold is flooded, opening and closing means for opening and closing said gate means so as to enable said flotation loading and unloading, and barge-moving means in said hollow interior comprising flow-creating means for causing flow of water to move barges in said hold in one direction during flotation loading and in the other direction during flotation unloading, said barge-moving means also comprising rollers adjacent said gate means for engagement with the sides of the barges and power means for driving some said rollers, for aiding in moving barges into and out from said hollow interior.

6. A barge-carrying waterborne vessel including in combination:

a hull with rigid supporting and hull-reinforcing structure, a bow, a stern, and side walls providing a series of buoyancy compartments, said hull having a hollow interior defining at least one longitudinal hold extending most of the length of said vessel, flooding means for putting water into said hold to the depth of the vessel's waterline, gate means at one end of said vessel for flotation loading and unloading of said hold, when said hold is flooded, with a plurality of barges, barge-retention means in said hold for holding each said barge down against the bottom of a said hold, for preventing movement of the barges, and for enabling exchange of buoyancy between each said barge and said vessel when said hold is flooded, opening and closing means for opening and closing said gate means so as to enable said flotation loading and unloading, and barge-moving means in said hollow interior comprising flow-creating means for causing flow of water to move barges in said hold in one direction during flotation loading and in the other direction during flotation unloading, said barge-retention means including shaped walls on at least one side of each said hold for receiving barges in an interlocking position when the hold is substantially free from water, and movable barge-engaging means anchored to the opposite side of each said hold for movement against the barge to retain it in said interlocked position whether or not said hold is flooded.

7. The vessel of claim 6 wherein said movable barge-engaging means comprises a hydraulic device with a cylinder and piston.

8. The vessel of claim 6 wherein said barge is provided with an external longitudinal rib on each side, said shaped wall including a rib-engaging fender projecting from said wall at a height above said rib when said barge is stowed, and said movable barge-engaging means comprises a hydraulic device with a cylinder and piston, one of which is movable at an angle down and out from the wall to which it is anchored and having a rib-engaging member on its outboard end.

9. The vessel of claim 1 wherein said barge-retention means comprises a series of flexible linear members, means for securing one end thereof to said barge, and means for securing the other end thereof to said hold.

10. The vessel of claim 1 wherein said barge-retention means comprises a series of flexible linear members and means for anchoring each end thereof to said hold.

11. A barge-carrying waterborne vessel including in combination:

a hull with rigid supporting and hull-reinforcing structure, a fixed box, a stern, and side walls providing a series of buoyancy compartments, said hull having a hollow interior defining a plurality of laterally adjacent longitudinal holds separated by longitudinal bulkhead means, extending most of the length of said vessel, the bulkhead means having near the stern end thereof and between adjacent holds, a lateral passageway therethrough spanned by a structure-strengthening archway for enabling shifting of barges laterally between adjacent holds beneath said archway, when said holds are flooded, flooding means for putting water into said holds to a depth of the vessel's waterline, gate means at the stern end of said vessel substantially the width of one said hold for flotation loading and unloading of said holds, when said holds are flooded, with a plurality of barges, barge-retention means in said holds for holding each said barge down against the bottom of a said hold, for preventing movement of the barges, and for enabling exchange of buoyancy between each said barge and said vessel when said hold is flooded, opening and closing means for opening and closing said gate means so as to enable said flotation loading and unloading, and barge moving means in said hollow interior comprising fore-and-aft flow-creating means for causing flow of water to move barges in each said hold forward during flotation loading, and aft during flotation unloading, and lateral jet nozzles in said side walls and facing a said archway for causing impingement of water jets upon the sides of a barge to move it laterally through said archways.

12. The vessel of claim 11 wherein said barge moving means also comprises powered rollers adjacent said gate means for engaging barge side walls, for aiding in moving barges between said gate means and said lateral passageway.

13. The vessel of claim 11 wherein there are two said longitudinal holds and one said bulkhead means with one said archway, said gate means lying in line with said archway, said hollow interior having a barge conduit leading from said gate to said bulkhead and said archway.

14. The vessel of claim 13 wherein the length of said barge conduit from said gate means to the nearer end of said bulkhead means is approximately twice the length of said archway, so that after said holds have been filled with barges of approximately the same length as said archway, two barges of that length or one barge of twice that length can be stowed in said barge conduit.

15. The vessel of claim 14 having said barge-retention means in said barge conduit as well as in said holds.

16. The vessel of claim 14 wherein said barge-moving means also comprises a pair of power-driven wheels on one side of said barge conduit, one closely adjacent said gate means and a second one about a barge length therefrom, adjacent the gate-facing end of said archway, and a pair of spring-urged idler wheels, one opposite each said power-driven wheel and on the opposite side of the barge conduit therefrom, for aiding in moving barges in both directions into said conduit and within said conduit, said wheels being set to engage the opposite sides of the barges.

17. The vessel of claim 16 wherein said wheels are located above the vessel's waterline.

18. The vessel of claim 16 having an additional power wheel at the archway end of said bulkhead means for assisting in moving said barges laterally through said archway.

19. The vessel of claim 11 wherein there are three said longitudinal holds and two said bulkhead means, each with a said archway, the archways being laterally opposite each other, said gate means lying longitudinally in line with the center said hold, said hollow interior having a barge conduit leading from said gate to said archways and said bulkheads.

20. The vessel of claim 19 having said barge-retention means in said barge conduit as well as in said holds.

21. The vessel of claim 20 wherein said barge-moving means also comprises a pair of power-driven wheels on one side of said barge conduit, one closely adjacent said gate means and a second one adjacent said archways and a pair of spring-urged idler wheels, one opposite each said power-driven wheel on the opposite side of said barge conduit therefrom, for aiding in moving barges in both directions into said conduit and within said conduit by engagement with the opposite sides of the barges.

22. The vessel of claim 21 wherein said wheels are located above the vessel's waterline.

23. The vessel of claim 21 having an additional power wheel at the archway end of said bulkhead means for assisting in moving said barges laterally through said archway.

24. A barge-carrying system, including in combination:

a series of substantially identical barges, and a barge-carrying waterborne vessel, each said barge having side walls with external longitudinally-extending rib means thereon, substantially trapezoidal in shape with upper and lower sloping portions and a vertical outboard surface, said barge below said rib having a vertical wall leading by a short sloping portion to a flat bottom, said waterborne vessel comprising:

a hull with rigid supporting and hull-reinforcing structure, a fixed bow, a stern, and side walls providing a series of buoyancy compartments, and a barge hold bottom always lying below the level of the sea, said hull having a hollow interior defining at least one longitudinal hold extending most of the length of said vessel, flooding means for putting water into said holds, to the level of the sea outside, gate means at the stern end of said vessel for flotation loading and unloading of said hold, when said hold is flooded, with a plurality of said barges, opening and closing means for opening and closing said gate means so as to enable said flotation loading and unloading, and retention means in said hold for holding each said barge down against the bottom of a said hold, for preventing movement thereof, and for enabling exchange of buoyancy between each said barge and said vessel when said hold is flooded, said retention means comprising:

a barge-locking fender on a first side wall of said hold, trapezoidal in shape with upper and lower sloping surfaces, with the lower surface adapted to engage the upper surface of a said barge rib means when the barge is in stowed position and resting on the bottom of said hold, an opposite, second side wall spaced from said first side wall by a distance somewhat greater than the over-all width of the barges, inclusive of their said rib means, and having a lower sloping bilge, corresponding in angle to the slope of the barge sloping portion leading to its flat bottom to help to guide the barge when the hold is being drained of water into the position where the barge rests at the hold bottom with a rib fitting into said trapezoidal recess, and releasable locking means associated with said second side wall for locking said barge to said hold when said rib means is in engagement with the lower surface of said trapezoidal fender.

25. The system of claim 24 wherein there is a lower side wall portion on said first side wall spaced downwardly from said fender and having an upper sloping surface, defining with said fender a trapezoidal recess for reception of a barge rib means, and having a vertical wall therebelow leading to a flat hold bottom, against which the barge rests while in transit and when the hold is dry.

26. The system of claim 24 wherein said releasable locking means comprises:

said second side wall being hollow and telescoping securing means in said hollow wall providing a locking member that is projectable downwardly and outwardly beyond said second side wall with engagement with the upper surface of a said rib means and an adjacent portion of the barge side wall, for positively holding said barge in place.

27. The system of claim 26 wherein said telescoping securing means comprises an hydraulically actuated device anchored to said second side wall and having a cylinder, a piston, and an outboard barge-engaging member.

28. The system of claim 27 having mechanical locking means for mechanically locking said barge-engaging member in its extended position for retention of the barge without continuous exertion of fluid pressure.

29. The system of claim 24 wherein said releasable locking means comprises:

a series of linear members of predetermined length, barge-anchoring means for securing one end of each said linear member to the barge, and hold-anchoring means for securing the other end of each said linear member to said hold with said linear member in extension.

30. The system of claim 29 wherein each said barge has, along an upper surface near the side edge a series of bitts and said barge-anchoring means comprises said bitts and loops on one end of said linear members, and said hold has a plurality of recessed sockets with an anchor bar and said hold-anchoring means comprises this bar and a hook on the other end of said linear member.

31. The system of claim 30 wherein said linear member comprises take-up means to assure that it can be stretched tightly when anchored at both ends.

32. The system of claim 24 having barge moving means in said hollow interior comprising fore-and-aft flow creating means for causing water to flow forwardly to move barges in said hold forward during flotation loading and to flow aft during flotation unloading to move said barges aft.

33. A barge-carrying system, including in combination:

a series of substantially identical barges, each having a series of bitts projecting up from its upper surface along each edge thereof, and a barge-carrying waterborne vessel comprising:

a hull with rigid supporting and hull-reinforcing structure, a fixed bow, a stern, and side walls providing a series of buoyancy compartments, and a barge hold bottom always lying below the level of the sea, said hull having a hollow interior defining at least one longitudinal hold extending most of the length of said vessel, flooding means for putting water into said holds, to the level of the sea outside, gate means at the stern end of said vessel for flotation loading and unloading of said hold, when said hold is flooded, with a plurality of barges, opening and closing means for opening and closing said gate means so as to enable said flotation loading and unloading, and retention means in said hold for holding each said barge down against the bottom of a said hold, for preventing movement thereof, and for enabling exchange of buoyancy between each said barge and said vessel when said hold is flooded, the retention means for one said barge comprising:

a plurality of series of anchor sockets, recessed into said holdd and each having an anchor bar thereon, one said series lying to one side of the said barge and the other to the other side thereof, and a series of linear members each having an end means for securing it to a said bitt and on the other end means for securing it to a said anchor bar, and having length-adjusting means.

34. The system of claim 33 having barge moving means in said hollow interior comprising fore-and-aft flow creating means for causing water to flow forwardly to move barges in said hold forward during flotation loading and to flow aft during flotation unloading to move said barges aft.

35. A barge-carrying waterborne vessel including in combination:

a hull with rigid supporting and hull-reinforcing structure, a fixed bow, a stern, and side walls providing a series of buoyancy compartments, and a barge hold bottom always lying below the level of the sea, said hull having a hollow interior defining at least one longitudinal hold extending most of the length of said vessel, flooding means for putting water into said holds, to the level of the sea outside, gate means at the stern end of said vessel for flotation loading and unloading of said hold, when said hold is flooded, with a plurality of barges, opening and closing means for opening and closing said gate means so as to enable said flotation loading and unloading, and retention means in said hold for holding each said barge down against the bottom of a said hold, for preventing movement thereof, and for enabling exchange of buoyancy between each said barge and said vessel when said hold is flooded, said retention means comprising:

a series of pad-eyes on one side of said hold, a series of anchor members on the other side of said hold, a series of flexible linear members secured at one end to a said pad-eye and, passing over a said barge, secured to a said anchor member, and take-up means for varying the length of each said tension member to assure tight stowage of said barge.

36. A barge-carrying waterborne vessel including in combination:

a hull with rigid supporting and hull-reinforcing structure, a fixed bow, a stern, and side walls providing a series of buoyancy compartments, and a barge hold bottom always lying below the level of the sea, said hull having a hollow interior defining at least one longitudinal hold extending most of the length of said vessel, flooding means for putting water into said holds, to the level of the sea outside, gate means at the stern end of said vessel for flotation loading and unloading of said hold, when said hold is flooded, with a plurality of barges, opening and closing means for opening and closing said gate means so as to enable said flotation loading and unloading, retention means in said hold for holding each said barge down against the bottom of a said hold, for preventing movement thereof, and for enabling exchange of buoyancy between each said barge and said vessel when said hold is flooded, said retention means comprising:

a series of pad-eyes on one side of said hold, a series of anchor members on the other side of said hold, a series of flexible linear members secured at one end to a said pad-eye and, passing over a said barge, secured to a said anchor member, and take-up means for varying the length of each said tension member to assure tight stowage of said barge, and barge-moving means in said hollow interior comprising fore-and-aft flow creating means for causing water to flow forwardly to move barges in said hold forward during flotation loading and to flow aft during flotation unloading to move said barges aft.

37. A barge-carrying waterborne vessel including in combination:

a hull with rigid supporting and hull-reinforcing structure, a fixed bow, a stern, and side walls providing a series of buoyancy compartments, and a barge hold bottom always lying below the level of the sea, said hull having a hollow interior defining a pair of laterally adjacent longitudinal holds separated by a longitudinal bulkhead extending most of the length of said vessel, said bulkhead having near its stern end a vertical opening therethrough spanned by an archway for enabling shifting of barges laterally between holds, gate means at the stern end of said vessel substantially the width of one said hold for flotation loading of all said holds, when said holds are partially flooded, with a plurality of barges, a loading passageway between said stern gate and said longitudinal holds aft of said archway, capable of receiving and stowing at least one said barge aft of said archway, a powered barge-propelling roller assembly in said loading passageway for moving a barge forward or aft therein, retention means in said holds and said loading passageway for holding each said barge down against the bottom of said vessel to prevent movement of said barges after stowage and to enable exchange of buoyancy between said barges and said vessel when water is in said hold, opening and closing means for opening and closing said gate means so as to enable said flotation loading and unloading of said vessel, closable water inlet-outlet means in the bottom of each said hold adjacent the fore end thereof, for enabling movement of water out from a said hold, a sea chest and valve connected to said inlet-outlet means for flooding said holds to the same level as that of the sea, pumping means connected to each said inlet-outlet means for positively pumping water out from or into each said hold through its said water inlet-outlet means, for inducing water flow in each said hold from the stern gate to the fore end of said hold for moving barges into said hold, for inducing water flow in the opposite direction for moving barges out toward said gate means, and for enabling the drying out of said hollow interior, and water-jet means in the side walls opposite an adjacent said archway for forcing water jets against the sides of a barge and enabling sidewise movement of a said barge through a said vertical opening.

38. A barge-carrying waterborne vessel including in combination:

a hull with rigid supporting and hull-reinforcing structure, a fixed bow, a stern, and side walls providing a series of buoyancy compartments, said hull having a hollow interior defining a plurality of adjacent longitudinal holds separated by longitudinal bulkhead means, extending the length of said vessel, a plurality of gate means at the stern end of said vessel, each substantially the width of one said hold for flotation loading of each said hold, when said hold is flooded, with a plurality of barges, a powered barge-propelling roller assembly in each said hold adjacent its said gate means for moving barges fore or aft through said gate means, retention means in said hollow interior for holding each said barge down against the bottom of a said hold to prevent movement thereof and to enable exchange of buoyancy between said barge and said vessel when water is in said hold, opening and closing means for opening and closing each said gate means separately so as to enable said flotation loading and unloading of said vessel, closable water inlet-outlet means in the bottom of each said hold adjacent the fore end thereof, for enabling movement of water out from a said hold, a sea chest with a valve connected to each said inlet-outlet means, for flooding said vessel to the same level as the sea outside, and pumping means connected to each said inlet-outlet means for pumping water out from or into each said hold through its said water inlet-outlet means for inducing water flow in said hold from its stern gate to the fore end of said hold for moving barges into said hold, for inducing water flow in the opposite direction for moving barges out toward said gate means, and for enabling the drying out of said hollow interior.

39. A method for loading a barge-carrying waterborne vessel having a hull with a fixed bow, a stern having an openable gate, a loading bay near said gate with power driven wheels for engaging barge sides above waterline, side walls providing a series of buoyancy compartments and pumping means therefor, and a hold having a sump at its forward end connected to said pumping means and also to a sea chest with a valve, comprising the steps of:

opening the sea chest valve to flood the hold through its sump until the water levels of the external sea and the internal barge hold are equalized, closing the sea chest valve, opening the stern gate, pumping water from said hold out through said forward sump into the sea, to cause forward flow of water in said hold, causing barges to enter one at a time through said stern gate into said bay while propelling it forward by driving said wheels and by said forward water flow, sending each barge further into said hold by said forward water flow, until all said barges are in stowage position, closing said stern gate when the barges are in stowage position, pumping the hold dry so that the barges settle on the hold bottom, and locking the barges to said vessel against relative movement.

40. The method of claim 39, wherein unloading comprises the steps of:

unlocking the barges from the hold, opening the sea chest to flood the hold through its sump until the external sea and internal barge-hold water level are equalized, closing the sea chest valve, opening the stern gate, pumping water from the sea into said hold through said forward sump to cause aftward flow of water in said hold, and causing each barge to leave through said stern gate by propelling it out by driving said wheels and by said aftward water flow.

41. The method of claim 39 wherein unloading comprises the following steps:

opening the sea chest valve to flood both holds through their sumps until the water levels of the external sea and the holds are equalized, closing the sea chest valve, opening the stern gate, pumping water from the sea into one said hold through its said forward sump to cause water to flow aftward toward said gate, causing the barge in said bay and then the barge beneath the archway to move aft and out through said gate, by water flow and by driving said wheels against it, transferring the barges one at a time from said one hold to said bay by jetting water against its sides, the remaining barges being moved aft by water flow each time a barge is so transferred, the transferred barge then being moved aft and out said gate as the preceding barges, until said one hold is empty, and in like manner transferring the barges from the other said hold and moving them out through said gate.

42. A method for loading a barge-carrying waterborne vessel having a hull with a fixed bow, a stern having an openable central gate, a loading bay near said gate with power-driven wheels for engaging barge sides above waterline, side walls providing a series of buoyancy compartments and pumping means therefor, and a hollow interior divided by a longitudinal bulkhead into two holds, each hold having a sump at its forward end connected to said pumping means and also to a sea chest with a valve, said holds being joined by a lateral passageway through said bulkhead, comprising the steps of:

opening the sea chest valve to flood both holds through their sump until the water levels of the external sea and the internal holds are equalized, closing the sea chest valve, opening the stern gate, pumping water from a first said hold through its said forward sump into the sea to cause forward flow of water into and in said first hold, causing barges to enter one at a time through said stern gate into said bay which propels it forward by driving said wheels and by said forward water flow, transferring barges one at a time from said bay into said first hold by jetting water against the sides of said barge while it is in said lateral passageway, moving each such transferred barge forward by said water flow until said first hold is filled, ceasing to pump water through the forward sump of said first hold, pumping water from the second hold through its said forward sump into the sea to cause forward flow of water into and in said second hold, transferring barges one at a time from said bay into said second hold by jetting water against the sides of said barge while it is in said lateral passageway, moving each such transferred barge forward by said water flow until said second hold is filled, retaining a barge against said bulkhead under said lateral passageway and centrally of said vessel, retaining a barge in said bay, ceasing to pump water through the forward sump of said second hold, closing said stern gate when all the barges are in their stowage position, pumping both holds and the bay dry so that the barges settle on the hold and bay bottoms, and locking the barges against movement relative to said vessel.

* * * * *